US007104625B2

(12) United States Patent
Kono et al.

(10) Patent No.: US 7,104,625 B2
(45) Date of Patent: Sep. 12, 2006

(54) INK JET PRINTING APPARATUS AND METHOD OF CONTROLLING INK JET PRINTING APPARATUS

(75) Inventors: Tetsushi Kono, Tokyo (JP); Norio Shimura, Kanagawa (JP); Masaya Kikuta, Kanagawa (JP); Takeaki Nakano, Tokyo (JP); Hirokazu Kameda, Kanagawa (JP); Masaaki Endo, Tokyo (JP); Manabu Kuchiki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 249 days.

(21) Appl. No.: 10/782,786

(22) Filed: Feb. 23, 2004

(65) Prior Publication Data

US 2004/0165018 A1 Aug. 26, 2004

(30) Foreign Application Priority Data

Feb. 26, 2003 (JP) ..... 2003-050122

(51) Int. Cl.
*B41J 29/38* (2006.01)

(52) U.S. Cl. ..... 347/14; 347/19; 347/37

(58) Field of Classification Search ..... 347/14
See application file for complete search history.

(56) References Cited

U.S. PATENT DOCUMENTS 5,074,690 A * 12/1991 Del Signore et al. ..... 400/322
5,477,963 A * 12/1995 Mochizuki et al. ..... 206/701
6,074,107 A * 6/2000 Sahori et al. ..... 396/513
6,095,629 A * 8/2000 Froger et al. ..... 347/7
6,224,183 B1 5/2001 Kono et al.
6,318,834 B1 * 11/2001 Otsuka et al. ..... 347/23
6,450,610 B1 9/2002 Shimura
2004/0113966 A1 * 6/2004 Chung ..... 347/19

* cited by examiner

*Primary Examiner*—Vip Patel
*Assistant Examiner*—Brian J. Goldberg
(74) *Attorney, Agent, or Firm*—Fitzpatrick, Cella, Harper & Scinto

(57) ABSTRACT

An object of this invention is to provide an ink jet printing apparatus that can detect a state causing a printing operation failure without adding a sensor and also enhance the ease of handling on the part of the user while keeping an apparatus cost from rising. For this purpose, in a serial type ink jet printing apparatus, a travel range in which the print head can be moved is detected and it is decided whether the detected travel range is a proper travel range. When, for example, the travel range is determined to be less than a preset range, it is decided that there is an obstacle in a path of the print head and a decision result is displayed. When the travel range is determined to be a certain range, it is decided that the ink tank is not properly mounted on the print head and the corresponding indication is made.

5 Claims, 10 Drawing Sheets

201
205
Q1
Q2
403
204a
204b
403b
L2
706
403a
L0
L1
INK TANK REPLACEMENT POSITION
a:REFERENCE POSITION
b:MAXIMUM TRAVEL RANGE

INK JET PRINTING APPARATUS AND METHOD OF CONTROLLING INK JET PRINTING APPARATUS

This application claims priority from Japanese Patent Application No. 2003-050122 filed Feb. 26, 2003, which is incorporated hereinto by reference.

BACKGROUND OF THE INVENTION

1. Field of the Invention

The present invention relates to an ink jet printing apparatus of a so-called serial type which performs a printing operation by moving a print head in a main scan direction and also moving a print medium in a subscan direction crossing the main scan direction, and more particularly to an ink jet printing apparatus capable of easily detecting the condition of use of the printing apparatus and a method of controlling the same.

2. Description of the Related Art

A common serial type ink jet printing apparatus mounts one or more print heads on a carriage that moves in the main scan direction and also removably mounts on the print heads ink tanks accommodating inks to be supplied to the respective print heads. In the ink jet printing apparatus with the ink tanks removably mounted on the print heads, when the ink tanks run out of inks, the inks can be replenished by replacing the old tanks with new tanks filled with inks, facilitating their handling on the part of user.

One conventionally known construction for removably mounting ink tanks on print heads engages a part of each ink tank in a groove formed in the associated print head. In this construction, fitting a part of each ink tank in the groove formed in the associated print head can bring a liquid supply port formed at a bottom of each ink tank into hermetic engagement with an ink receiving port that communicates with a common liquid chamber of the print head. In this type of ink jet printing apparatus, the ink tanks must engage the corresponding print heads properly for supply of ink from the ink tanks to the print heads.

To meet this requirement, conventional ink jet printing apparatus employ a detection means, such as a sensor or switch, to determine whether or not the ink tanks are properly mounted to a mounting portion of the associated print head in order to alert the user when any tank is not properly mounted.

However, such a switch or sensor detects only the mounted state of ink tanks and does not detect any other conditions. Thus, from the standpoint of cost performance, such a detection means is not normally used in relatively inexpensive apparatus. In conventional apparatus therefore, any improper mounting of an ink tank at the start of the use of the apparatus or during an ink tank replacement results in ink failing to be supplied to the associated print head, which in turn causes an ink ejection failure of the print head.

In the serial type ink jet printing apparatus., a trouble may occur in which an obstacle present in a carriage path blocks a proper movement of the carriage.

For example, the user may inadvertently start using a printing apparatus without removing a protective material inserted in the apparatus for its protection during shipping. If power is initially turned on with the protective material (obstacle) left in the carriage path, a reference position of a print head is determined at a wrong position, which prevents the print head position from being recognized correctly in subsequent printing operations. In that case, a print medium fails to be fed at a correct timing with respect to the reciprocal movement of the print head, making it impossible to produce a desired printing operation.

To reliably prevent such a trouble, it is necessary to check for any obstacle present in the carriage path by using a sensor. This sensor, however, is not normally used in inexpensive printing apparatus and the resolving of this problem is entirely left to the user's careful handling during unpacking.

SUMMARY OF THE INVENTION

For solving the above-mentioned problem, it is an object of this invention to provide an ink jet printing apparatus which can detect a state of ink tanks mounted on the print head and a presence or absence of an obstacle in the path of the print head without adding a sensor and which also can enhance the ease of handling on the part of the user while keeping an apparatus cost from rising. It is also an object of this invention to provide a method of controlling such an ink jet printing apparatus.

To achieve the above objective, the present invention provides an ink jet printing apparatus which performs printing by moving a print head in a main scan direction and also feeding a print medium in a subscan direction crossing the main scan direction, the ink jet printing apparatus comprising: a detection means for detecting a travel range of the print head; a decision means for determining whether or not the detected travel range is a proper travel range; and a control means for performing a predetermined control if the decision means decides that the travel range of the print head is not the proper travel range.

In this invention, the detection means detects a range in which the print head can be moved and determines whether or not the detected travel range is a proper travel range, thereby determining whether an obstacle such as a protective packing material exists in a travel path of the print head. If there is an unwanted object such as a protective packing material in the path of the print head, the print head motion is interfered with by the obstacle. As a result, the travel range of the print head, as detected by the detection means, is shorter than a print head movable range that is available when there is no obstacle. The decision means therefore decides that the print head travel range is not a proper one and, based on this decision, the control means performs controls, such as displaying a predetermined indication and stopping a print head drive motor, to prevent a printing operation from being executed under an improper condition.

As described above, since this invention detects a movable range of the print head and checks if the detected movable range is an appropriate one, it is possible to detect undesired states that will result in operation failures, such as improperly mounted ink tanks on the print head and an obstacle lying in the path of the print head, without having to add a sensor. This in turn greatly facilitates the ease of use while keeping the apparatus cost from increasing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described.

(First Embodiment)

Figures 1A, 1B:
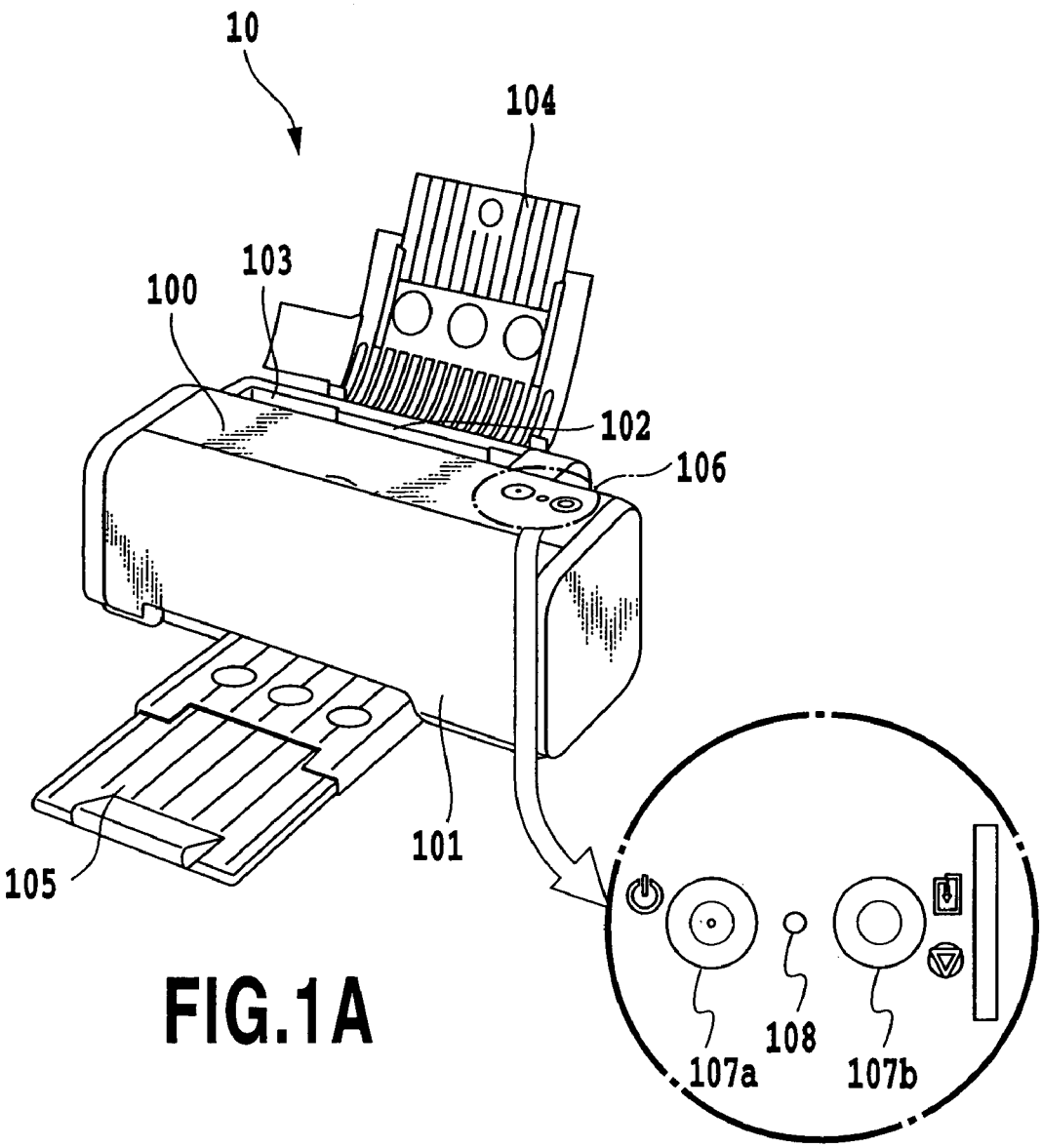
FIG. 1A is a schematic perspective view of an ink jet printing apparatus in a first embodiment of the present invention.
FIG. 1B is an enlarged view of an operation/display unit of FIG. 1A.

FIG. 1A is an external perspective view of an ink jet printing apparatus in a first embodiment of this invention; and FIG. 1B is an enlarged view showing an operation/display unit of FIG. 1A.

In FIG. 1A, reference numeral 10 denotes a serial type ink jet printing apparatus and 100 represents a body of the apparatus. The apparatus body 100 has an internal construction of FIG. 2 and also has mounted at its front a front cover 101 that can be opened and closed. On a top surface of the front cover 101 is mounted an operation/display unit 106, which, as shown in FIG. 1B, has switches 107*a*, 107*b* for turning the apparatus power on or off and setting a variety of printing modes and a display 108 for indicating a state of the printing apparatus. Opening the front cover 101 can expose the interior of the apparatus body 100 as shown in FIG. 3A, allowing the print head and ink tank to be accessed for replacement.

Figure 2:
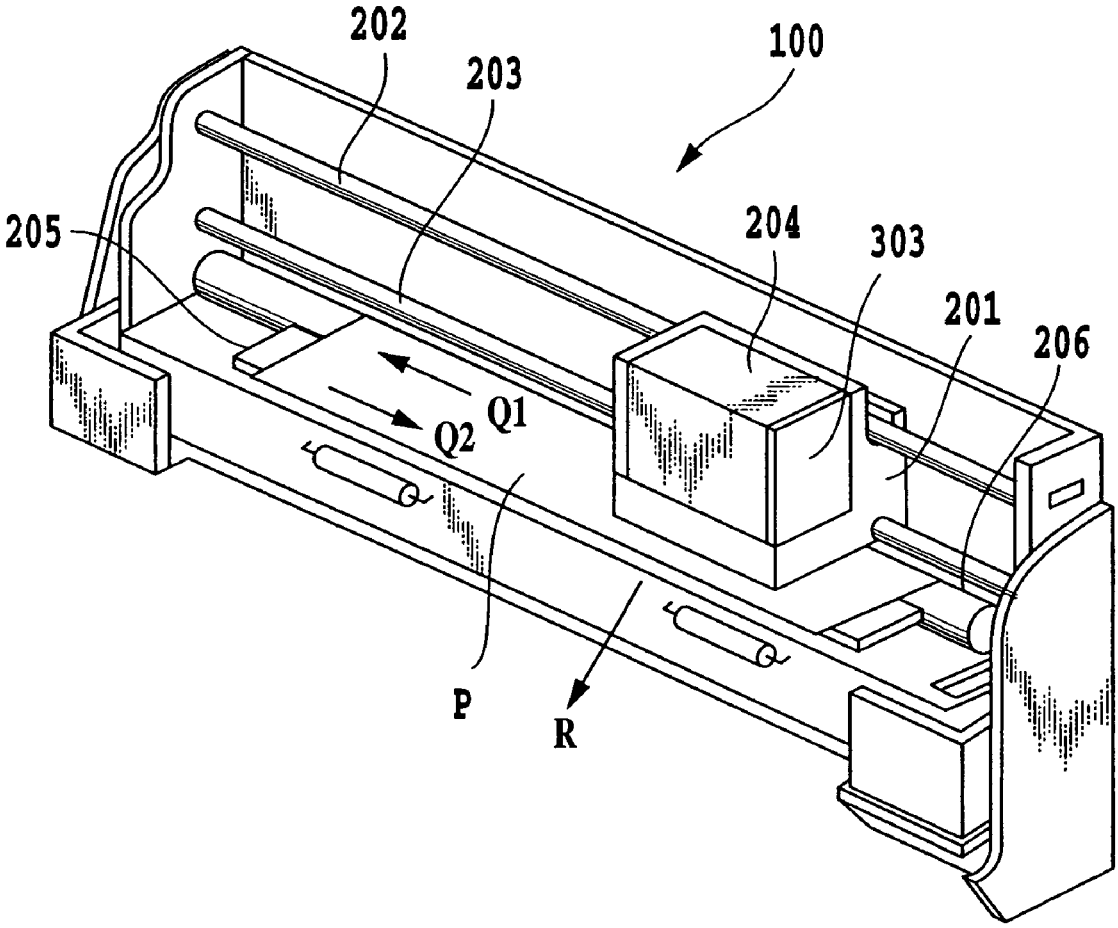
FIG. 2 is a perspective view schematically showing an inner construction of an ink jet printing apparatus body of this invention.
Figure 3A:
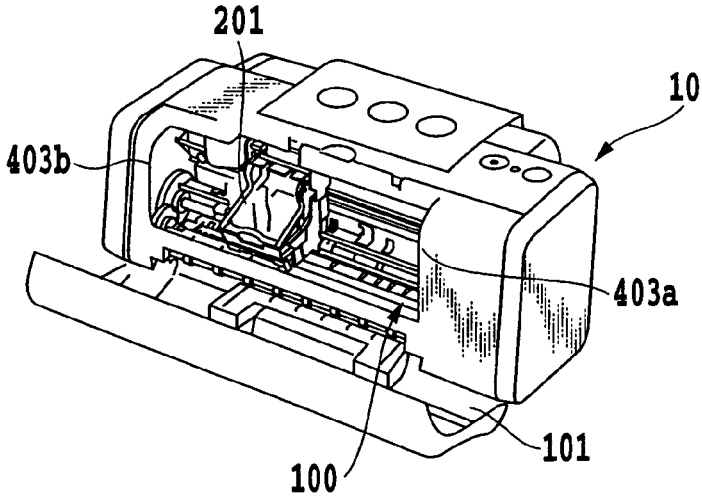
FIG. 3A is a perspective view showing how print heads and ink tanks are mounted on the ink jet printing apparatus of FIG. 1A, with a front cover open.
Figure 3B:
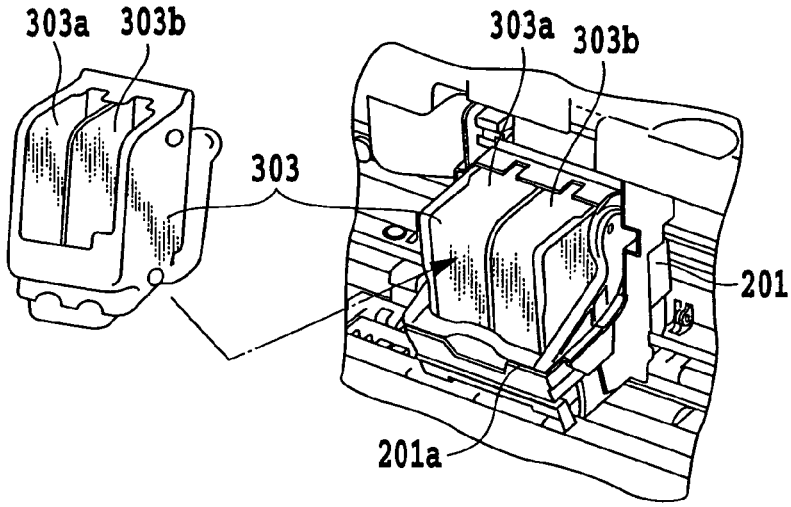
FIG. 3B is a perspective view showing how print heads are mounted on a carriage in the state of FIG. 3A.
Figure 3C:
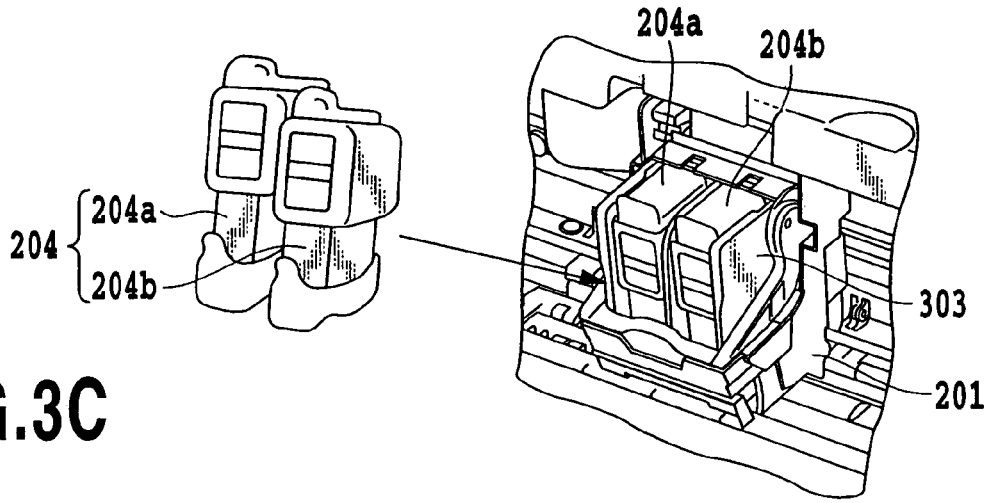
FIG. 3C is a perspective view showing how ink tanks are mounted on the print heads in the state of FIG. 3B.

FIG. 2 is a perspective view schematically showing an inner construction of the apparatus body 100.

In the figure, denoted 206 is a transport roller 206 which transports to a printable area a print medium P that was fed by an automatic paper feeder 102 to a paper feed position. The print medium P transported to the printable area by the transport roller 206 is now supported on a platen 205.

Designated 201 is a carriage movably supported on two parallel guide shafts 202, 203 installed in the apparatus body 100. On this carriage 201 is removably mounted a print head 303, on which an ink tank 204 is also removably mounted.

The carriage 201 is driven by a DC motor (not shown) to reciprocally move (main-scan) over a scan area including a print area in a main scan direction indicated by arrows Q1, Q2 (axial direction of the guide shafts 202, 203), during which time the print head 303 mounted on the carriage 201 ejects ink from its nozzles onto the print medium P situated immediately below to perform printing for one scan.

With one main scan completed, the print medium P is fed a predetermined distance in a subscan direction indicated by an arrow R and waits for the next scan. The main scan and subscan are alternately repeated until one page of printing is completed.

Now, referring to FIGS. 3A–3D, a construction and a procedure for mounting and removing the print head 303 and the ink tank 204 will be explained.

The print head 303 and the ink tank 204 are replaced by opening the front cover 301 provided on the front side of the apparatus body 100 as shown in FIG. 3A to expose the carriage 201 supported inside the apparatus body 100. The print head 303 is mounted on the carriage 201 by engaging the print head 303 in a container-like holder 201*a* formed on the carriage 201. In this embodiment, the print head 303 has four head portions for yellow (Y), cyan (C), magenta (M) and black (Bk) ink. These head portions, when mounted on the carriage 201, are electrically connected to a flexible printed circuit board and receive signals to eject ink.

The print head 303 has a plurality of ink tank accommodation portions (in this case, two) 303*a*, 303*b*, which can accommodate two independent ink tanks 204*a*, 204*b*. Of the two ink tanks 204*a*, 204*b*, the ink tank 204*b* is a black ink tank, a single container holding a black ink therein. The other ink tank 204*a* is a color ink tank, the interior of which is divided into three ink containers for holding Y, M and C inks respectively. Bottom portions of these ink tanks 204*a*, 204*b* are formed with ink supply ports for the associated ink containers (not shown). When these ink tanks 204*a*, 204*b* are properly mounted on the carriage 201, the ink supply ports of the individual ink containers communicate with ink receiving ports of the respective head portions of the print head 303, supplying inks from the ink containers to the print head 303.

Figure 4A:
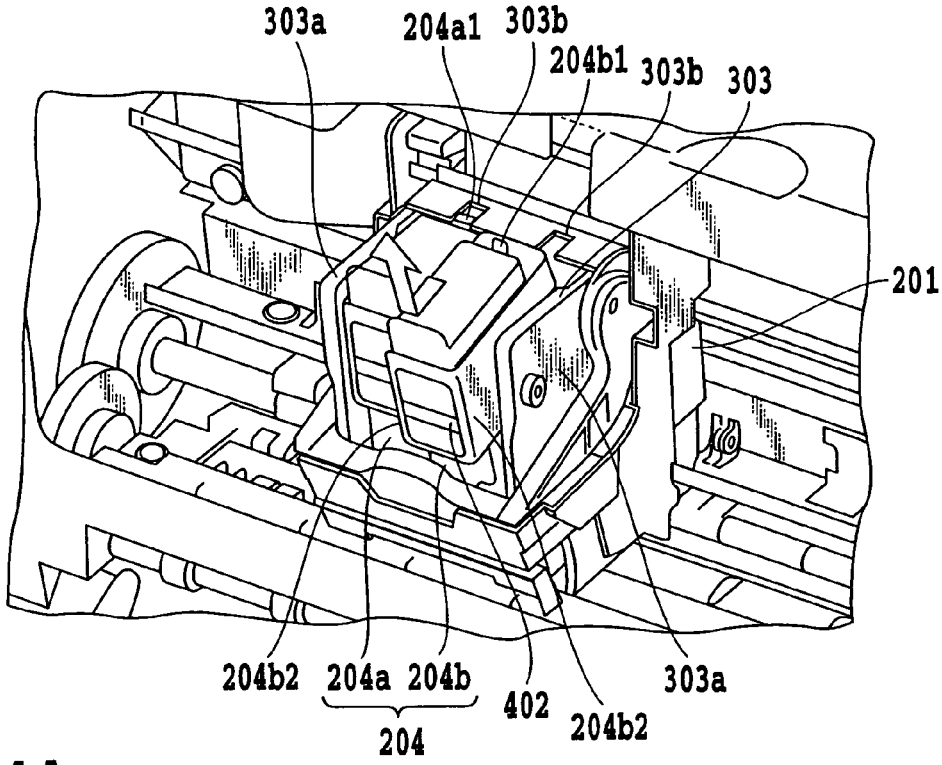
FIG. 4A is a perspective view showing the ink tanks improperly mounted on the print heads.

FIG. 4A shows the ink tanks 204*a*, 204*b* mounted on the print head 303. One of the ink tanks (color ink tank) 204*a* is correctly mounted on the print head 303 whereas the other ink tank (black ink tank) 204*b* is not yet fully mounted. When the ink tank 204*a* is correctly mounted on the print head 303, a back portion of the ink tank 204*a* is held almost vertically along a back of the print head 303 so that a front face of the ink tank 204*a* rests behind a front of sidewall portions 303*a* of the print head 303. In this state the ink tank 204*a* has its engagement projection 204*a*1 fit in an engagement recess 303*b* formed in a top surface of the print head 303 and is thus firmly held without play. When the properly mounted ink tank 204*a* is to be removed from the print head 303, an upper part of the ink tank 204*a* is pulled forward to disengage the engagement projection 204*a*1 from the engagement recess 303*b*.

In a state where the ink tank 204*b* is not yet fully mounted (before being mounted correctly), the ink tank 204*b* protrudes forwardly from the front of the sidewall portions 303*a* of the print head 303, with its engagement projection 204*b*1 disengaged from the engagement recess 303*b*. In this state, pushing the ink tank 204*b* rearward can bring it into the same properly mounted state as the ink tank 204*a*.

Figure 4B:
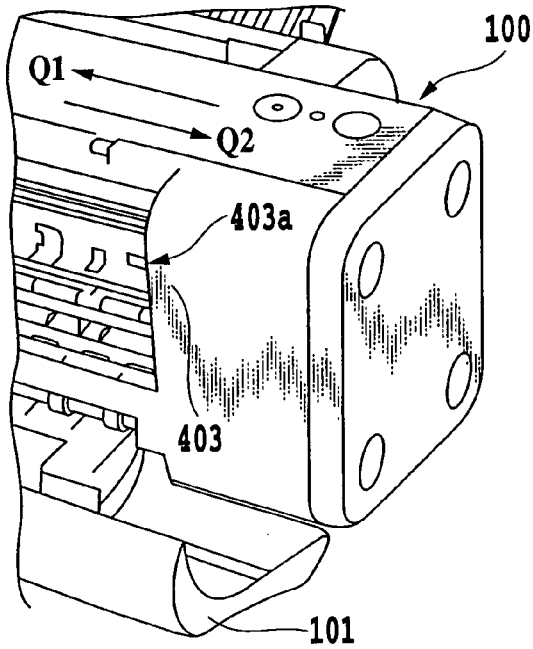
FIG. 4B is a perspective view showing a position where the improperly mounted ink tanks abut an enclosure of the printing apparatus when the carriage is moved.

When the ink tank 204*b* is not in the fully mounted state, moving the carriage 201 in the backward direction (Q2 direction) causes an ink tank wall surface 204*b*2 to interfere with one end portion 403*a* (see FIG. 4B) of a housing 403 enclosing the apparatus body 100, thereby preventing a further movement of the carriage in the backward direction (Q2 direction). When the carriage 201 is moved in the forward direction (Q1 direction), the other ink tank wall surface 204*b*2 of the ink tank 204*b* interferes with the other end portion 403*b* (see FIG. 3A) of the housing 403 enclosing the apparatus body 100, preventing a further movement of the carriage in the forward direction (Q1 direction). When both of the ink tanks 204*a*, 204*b* are in the properly mounted state, the carriage 201 can move in the forward and backward directions beyond a movable range or travel range that is available when one of the ink tanks is not fully mounted. The carriage travel range is maximum when both of the ink tanks are correctly mounted. This is one of the features of this embodiment of the invention.

When the ink tanks are not in the fully mounted state, as described above, the current position and the movable range of the carriage 201 can be determined by a carriage position detection sensor and a CPU in the control system described later. The carriage position detection sensor may use a conventionally available sensor, for example, a well-known linear encoder (not shown) having a scale arranged parallel to the guide shafts 202, 203. Even if the ink tanks 204*a*, 204*b* are properly mounted on the print head 303, when there is an obstacle in the paths of the carriage 201 and the print head 303, the travel range of the carriage 201 becomes shorter than the maximum movable range. The travel range of the carriage 201 and the travel range of the print head 303 mounted on the carriage 201 are the same, so in this specification no distinction is made between them.

Figure 5:
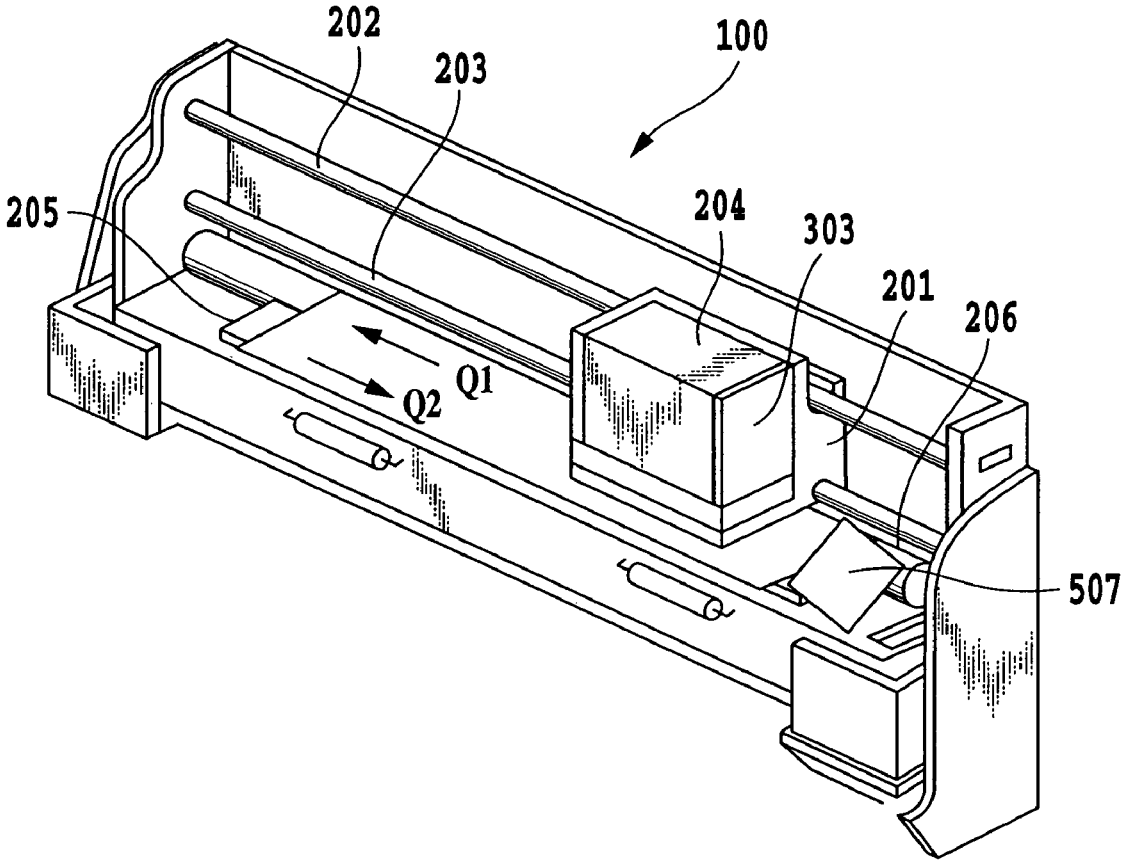
FIG. 5 is a perspective view showing an obstacle, such as a protection material for transport, in the carriage path in the ink jet printing apparatus body.

FIG. 5 shows an obstacle 507 present in the path of the carriage 201. This obstacle 507 may, for example, be a protective packing material filled in the path of the movable carriage 201 to protect the inner structure of the ink jet printing apparatus 10 during transport. The protective material 507 needs to be removed after the delivered ink jet printing apparatus 10 is unpacked and before it is used. Normally, this protective material 507 is not easily recognized as it is installed at the end of the path of the carriage 201, and thus the user often starts using the printing apparatus without removing the protective material.

Should the carriage 201 be driven with such a protective material 507 left in its path, the carriage 201 or the print head 303 interferes with the obstacle 507 and its movable range is limited to a shorter range than when the obstacle 507 is not present. The movable range of the carriage 201 is similarly reduced also when obstacles other than the protective material 507 exist in the paths of the carriage 201 and print head 303.

Figure 6:
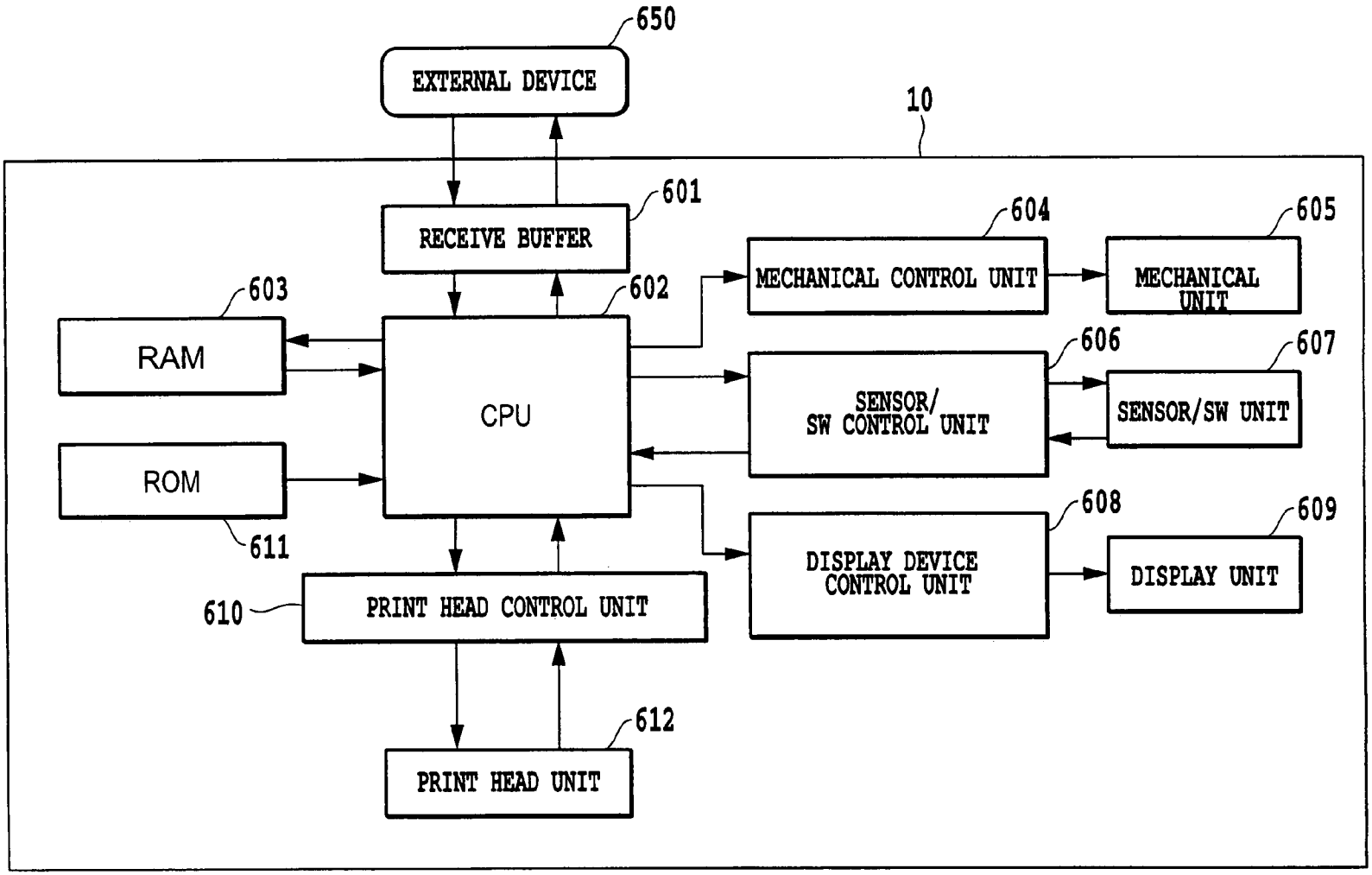
FIG. 6 is a block diagram showing an outline configuration of a control system for the ink jet printing apparatus.

FIG. 6 is a block diagram showing an outline configuration of a control system of the ink jet printing apparatus in the first embodiment.

Print data and control data, such as characters and images to be printed in the ink jet printing apparatus lo, are sent from an external device 650 such as a host computer to a receive buffer 601 of the apparatus body 100 where they are stored. Data for checking if what the external device 650 has transmitted is being correctly received by the apparatus body 100 and data indicating the operating state of the apparatus body 100 are returned from the ink jet printing apparatus 10 to the external device 650.

The data stored in the receive buffer 601 is processed into data, which is to be printed when the print head 303 performs main scans, under the control of a CPU 602 (control and decision means) that executes calculations, decisions and controls according to programs stored in a ROM 611. The processed data is temporarily stored in a print buffer in a random access memory (RAM) 603 and then transferred to a print head control unit 610, which in turn controls a print head unit 612 of the print head 303 to print data such as characters and images. The print head control unit 610 also reads temperature information representing the state of the print head unit 612 and sends it to the CPU 602 which in turn sends the corresponding control data to the print head control unit 610 to control the ink ejection operation of the print head 303.

A mechanical control unit 604, according to a command from the CPU 602, controls the driving of a mechanical unit 605 including a carriage drive motor and a line feed motor.

A sensor/SW control unit 606 sends signals from a sensor/SW unit 607 made up of various sensors and switches to the CPU 602. The sensor/SW unit 607 includes a carriage position detection sensor such as a linear encoder for detecting the position of the carriage 201. A display device control unit 608, according to commands from the CPU 602, controls a display unit 609 made up of LEDs and a liquid crystal display in the operation/display unit 106.

Figure 8:
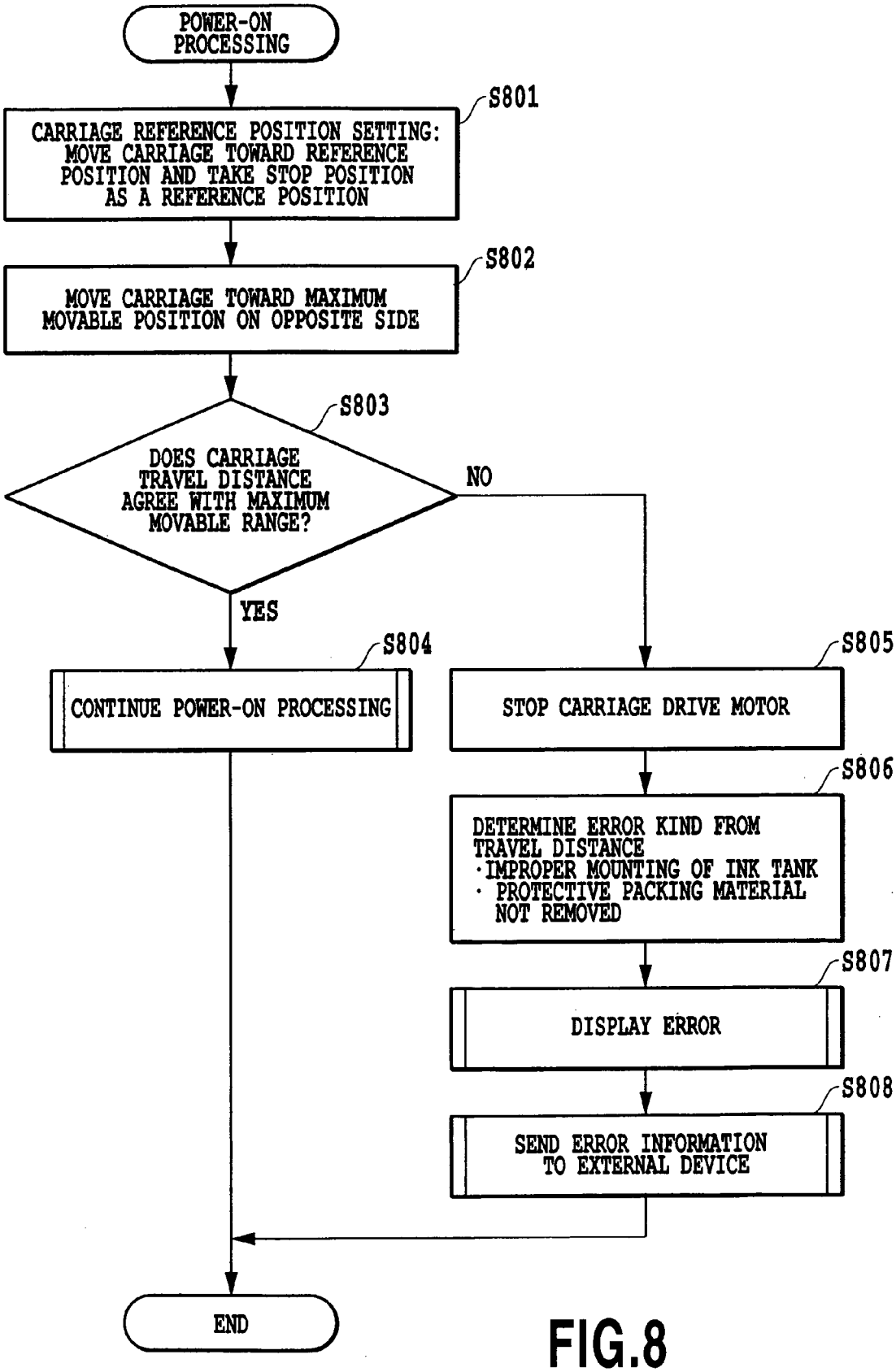
FIG. 8 is a flow chart showing a sequence of operations executed when a power is turned on in a first embodiment of the invention.
Figure 9:
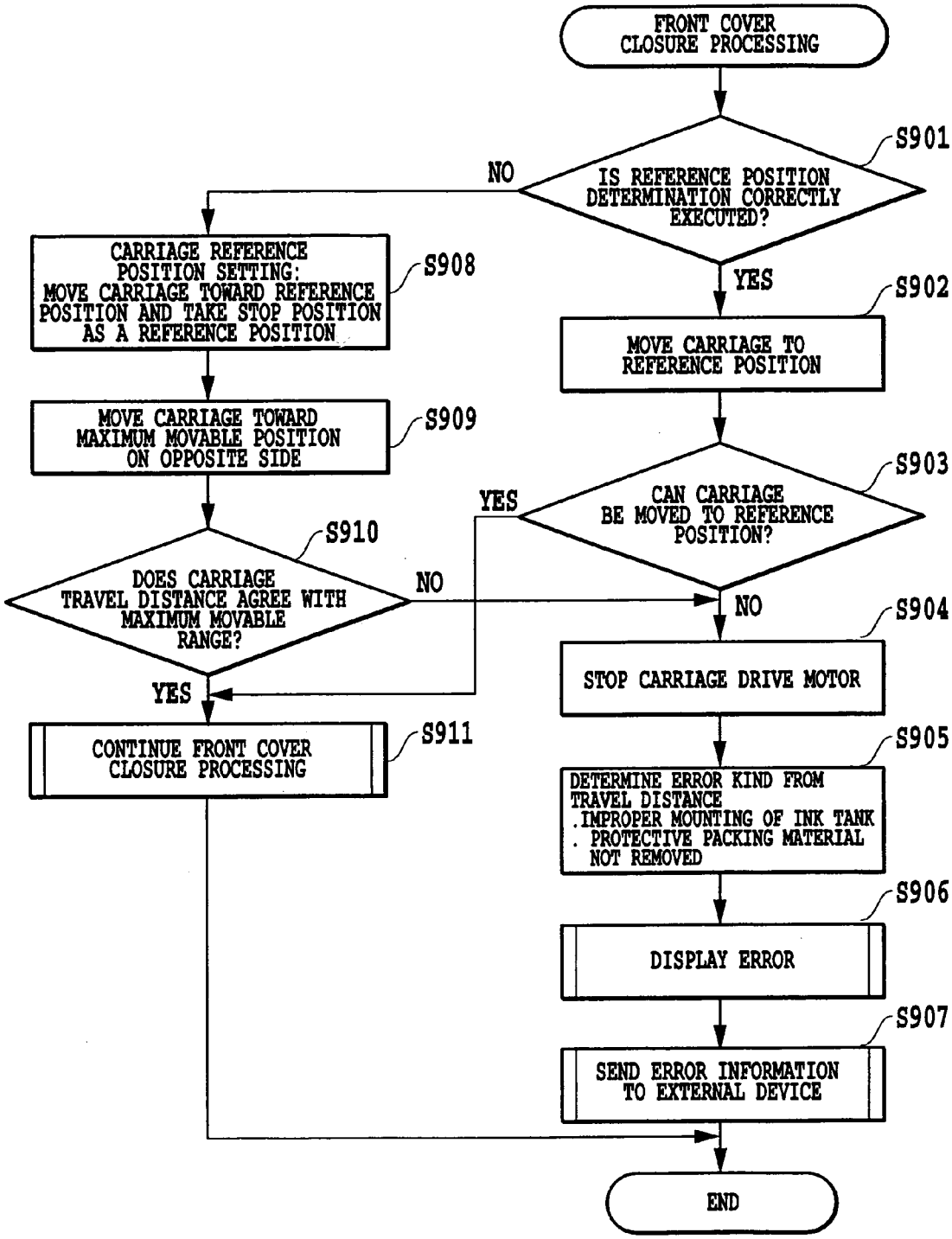
FIG. 9 is a flow chart showing a sequence of operations executed when a front cover is closed in the first embodiment of the invention.

Next, referring to FIGS. 7A–7D, FIG. 8 and FIG. 9, a method of checking a mounting state of the ink tanks 204 and a presence or absence of an obstacle in the path of the carriage will be described. FIGS. 7A–7D are explanatory plan views showing a positional relation between parts in the carriage path. FIG. 8 and FIG. 9 are flow charts showing detection sequences to check for an improper mounting of ink tanks and a presence or absence of an obstacle in the carriage path, FIG. 8 representing processing to be executed when a power is turned on and FIG. 9 representing processing to be executed when the front cover is closed.

In the first embodiment, the above detection operation is performed at two timings when a power is turned on and when the front cover is closed.

First, processing to be executed at a turn-on-of power will be explained below.

When a power switch of the ink jet printing apparatus 10 is turned on, power-ON processing shown in steps S801–S808 of FIG. 8 is executed. That is, immediately after the power is turned on, an absolute position of the carriage 201 is not known. Thus, the carriage 201 is moved in a direction Q2 (backward direction) toward a reference position (shown at a in FIGS. 7A–7D) and a position at which the carriage engages, and is stopped by, some member is temporarily taken as a preliminary reference position (step S801). Next, the carriage 201 is moved in a direction Q1 (forward direction) toward a maximum movable position (shown at b in FIGS. 7A–7D) at the other end of the path on a (non-reference) side opposite the reference position a. When the carriage engages some member and is stopped by it, a distance from this position to the preliminary reference position is determined (step S802). This is done by the CPU 602 counting the number of pulses received from the carriage position detection means. Then, it is checked whether the travel range or the distance traveled agrees with the preset maximum movable range (step S803). If the distance traveled is shorter than the maximum movable range, the processing moves to step S805 where it stops the carriage drive motor in the mechanical unit 605 through the mechanical control unit 604 (step S805). If the distance traveled agrees with the maximum movable range, the processing moves to step S804 to continue the predetermined power-ON processing.

Figures 7A, 7B, 7C, 7D:
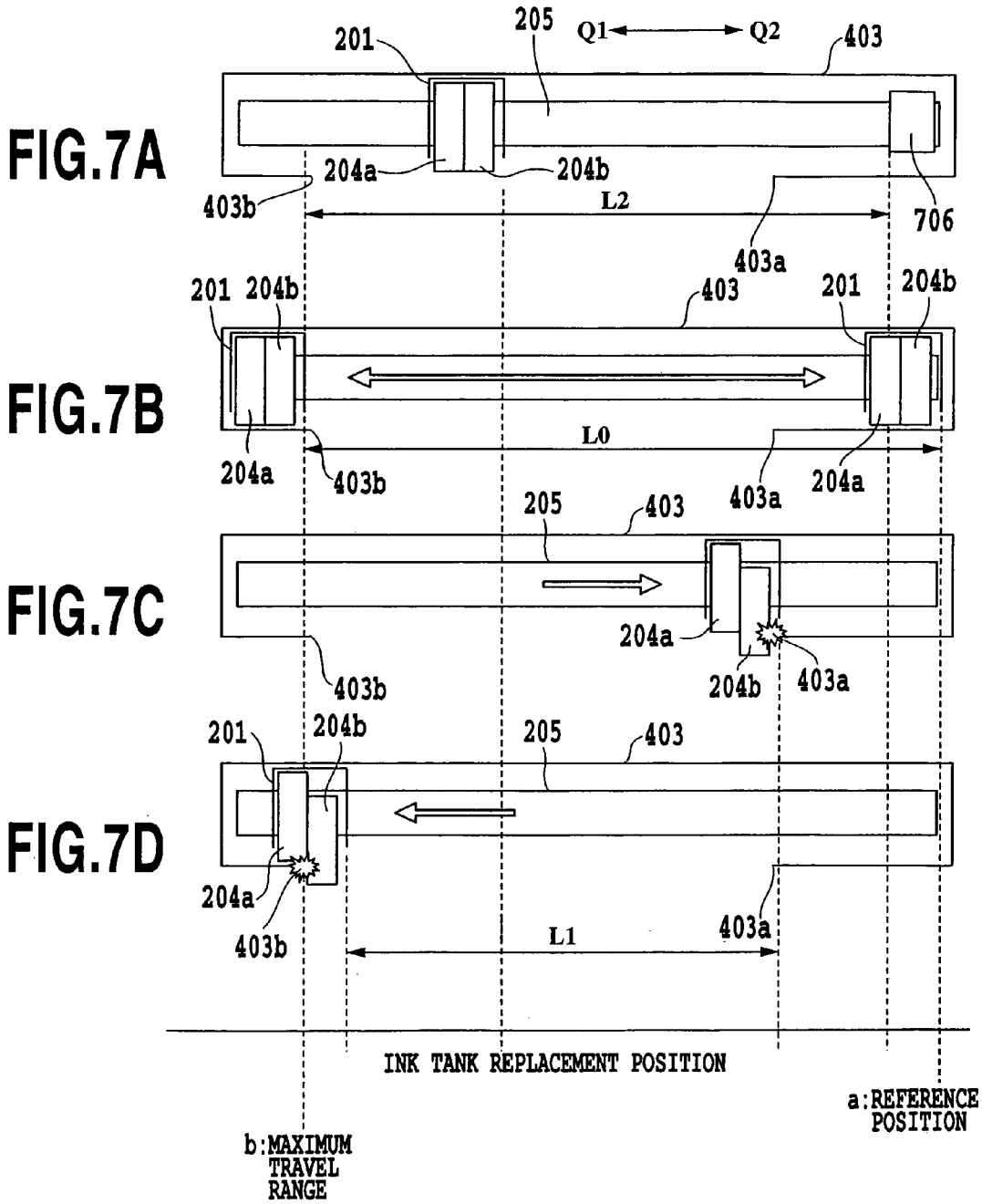
FIGS. 7A–7D are explanatory plan views showing how to determine whether an obstacle exists in a print head path and whether ink tanks are correctly mounted.

That is, when the ink tanks 204 are not fully engaged, the ink tanks 204 interfere with the end portions 403*a*, 403*b* of the housing 403 during the reciprocal movement as shown in FIG. 7C and FIG. 7D. As a result, the travel range L1 is shorter than the preset maximum movable range L0 (see FIG. 7B). Further, when a protective packing material 507 is left inserted in the path of the carriage 201, the carriage 201 interferes with the packing protective material 706 (see FIG. 7A) and therefore its travel range L2 becomes shorter than the preset maximum movable range L0. If the travel range or the distance traveled determined by step S802 differs from the maximum movable range L0, it is decided that an error has occurred and the carriage drive motor is quickly stopped.

Then, based on the distance traveled L1 or L2, it is determined whether the error in question is caused by an improper mounting of the ink tank (ink tank mounting error) or by a presence of an obstacle such as a protective packing material 507 (obstacle error) (step S806) and the corresponding indication is shown on the display unit 609 (step S807). Further, error information is sent to the external device 650 connected to the ink jet printing apparatus 10 (step S808) for appropriate display on the external device 650.

Next, processing executed when the front cover 101 is closed will be explained.

When the front cover 101 is closed, there are two possible states. One state is that the reference position of the carriage 201 is already correctly determined during the power-ON processing, and the other state is that the reference position has failed to be correctly determined during the power-ON processing (reference position is not yet determined). If the carriage position is not determined correctly immediately after the power is turned on, the absolute position of the carriage 201 is still unknown. Thus, if a check on a reference position of the printing apparatus (step S901) finds that the reference position is not yet determined, the front cover closing processing executes the reference position determination processing to determine the reference position. As in the power-ON processing described above, the carriage 201 is moved in the backward direction Q2 toward the reference position (indicated at a in FIGS. 7A–7D) and a position at which the carriage is blocked and stopped by some member is taken temporarily as a preliminary reference position (step S908). Next, the carriage 201 is moved in the forward direction Q1 toward the maximum movable position (indicated at b in FIGS. 7A–7D) at the other end of the path on a (non-reference) side opposite the reference position a. When the carriage abuts against and is stopped by some member, a distance from this position to the preliminary reference position is determined (step S909). This is done by the CPU 602 counting the number of pulses received from the carriage position detection means. Then, it is checked whether the travel range or the distance traveled agrees with the preset maximum movable range (step S910). If the distance traveled is shorter than the maximum movable range, the processing moves to step S904 where it stops the carriage drive motor in the mechanical unit 605 through the mechanical control unit 604 (step S904). If the distance traveled agrees with the maximum movable range, the processing moves to step S911 to continue the predetermined front cover closing processing.

If the reference position of the carriage 201 is already determined correctly by the power-ON processing, the carriage 201 is moved in the backward direction Q2 from an ink replacement position (indicated at c in FIGS. 7A–7D) toward the reference position (indicated at a in FIGS. 7A–7D) (step S902).

At this time, if the ink tanks 204 are in a correctly inserted position, the carriage 201 reaches the reference position a. In response to this, the predetermined processing (front cover closing processing) triggered by the closure of the front cover 101 is continued (step S911). However, when the ink tank 204*b* is not fully inserted, the carriage 201 cannot reach the reference position a because of an interference between the ink tank 204*b* and the end portion 403*a* of the housing 403. Hence, the carriage drive motor is quickly stopped (step S904). At the same time it is decided from the position of the carriage 201 detected at time of error that the error is caused by an improper mounting of the ink tank (step S905) and the corresponding indication is made on the operation/display unit 106 of the ink jet printing apparatus 10. At the same time, error information is sent to the external device 650 connected to the ink jet printing apparatus 10 for appropriate display on the external device (step S907). The error display is reset by power-OFF processing or cover opening processing.

(Second Embodiment)

Next, a second embodiment of this invention will be described by referring to FIG. 10.

In the second embodiment, as shown in FIG. 10, a plurality (in this case, two) of ink tanks 304*a*, 304*b* fitted in the print head 303 have different widths in the main scan direction. In other respects, the construction of the second embodiment is similar to that of the first embodiment.

Figure 10A:
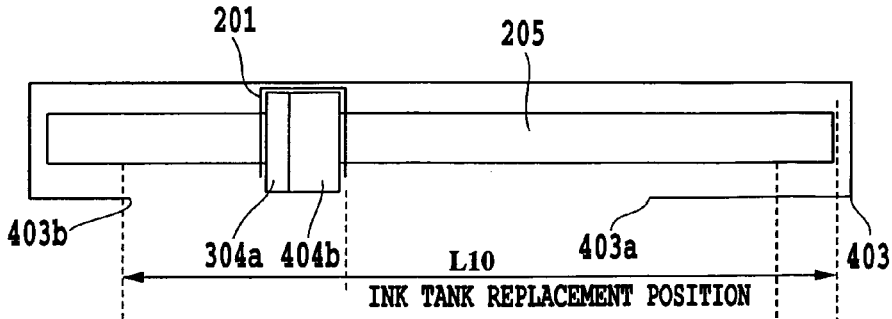
FIGS. 10A–10D are explanatory plan views showing how a kind of an improperly mounted ink tank is identified in a second embodiment of the invention.
Figure 10B:
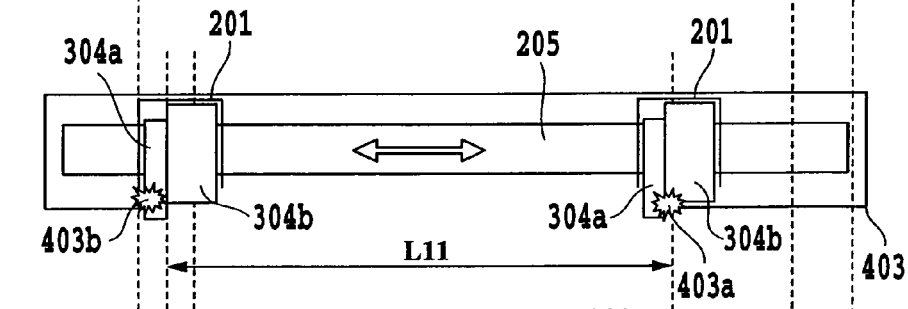
Figure 10C:
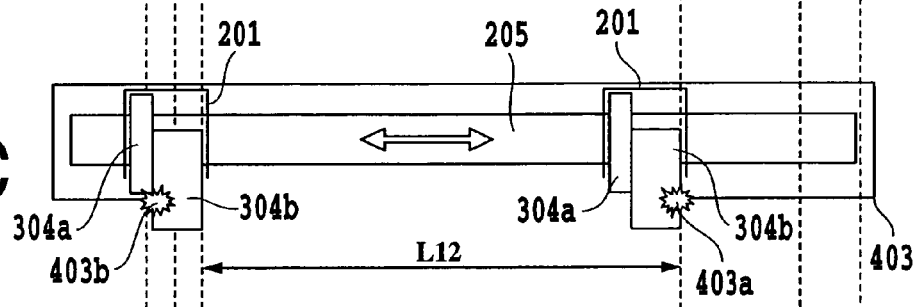
Figure 10D:
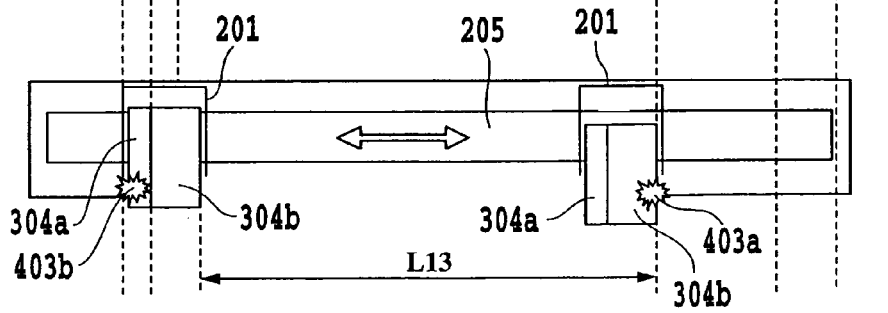

Taking advantage of the differing widths of the ink tanks 304*a*, 304*b*, the second embodiment makes it possible to identify which ink tank is in an improper mounting state. Let us consider a case where the width of the black ink tank 304*b* containing a black ink is set larger than that of the color ink tank 204*a* containing color inks. It is also assumed that only the color ink tank 304*a* is in an improper mounting state, as shown in FIG. 10B. The travel range of the carriage 201 is L11 which is dictated by an interference between the color ink tank 304*a* and the end portions 403*a*, 403*b* of the housing 403. This range is shorter than a travel range (maximum movable range) L10 in which the carriage 201 can move when both of the ink tanks 304*a*, 304*b* are properly installed (see FIG. 10A). If only the black ink tank 304*b* is in an improper mounting state as shown in FIG. 10C, the travel range of the carriage 201 is L12, which is shorter than the range L11 obtained when only the color ink tank 304*b* is in a proper mounting state. If both of the ink tanks 304*a*, 304*b* are in an improper mounting state as shown in FIG. 10D, the travel range of the carriage 201, L13, is shorter than the travel range L12.

Detecting the travel range of the carriage 201 and comparing it with the maximum movable range as described above can determine whether the ink tanks 204 are properly mounted or not. Further, by checking which of L11, L12 and L13 the travel range matches, it is possible to identify the improperly mounted ink tank and to indicate the check result on the display unit thereby providing the user with appropriate information.

In the above embodiments, a housing provided on the printing apparatus body is used as a member for restricting the movement of the carriage when the ink tanks are not fully mounted. The restricting member is not limited to the housing and may be constructed of a member protruding from other parts of the printing apparatus body.

Further, in the above embodiments, we have taken up an example case in which two ink tanks are installed on the print head. This invention is also applicable to cases where one ink tank or three or more ink tanks are mounted. For example, a print head configuration is available which has four color inks—cyan, magenta, yellow and. black—contained in independent ink tanks. In another configuration the print head has a total of six ink tanks, i.e., two ink tanks containing a light cyan ink and a light magenta ink in addition to the above four color inks. This invention is also applicable to these printing apparatus.

The above embodiments use a so-called bubble jet (trade mark) system in which the print head incorporates electrothermal transducers as a means to generate an energy for ejecting ink from its nozzles. A thermal energy generated by the electrothermal transducers produces bubbles in ink which, as they expand, expel ink droplets from the nozzles.

It is noted, however, that the present invention is not limited to a particular configuration of an ink ejection energy generation means in the print head but can also be applied to ink jet printing apparatus with print heads that use ejection energy generation means other than the electrothermal transducers, such as ones having piezoelectric devices.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet printing apparatus which performs printing by moving a print head in a main scan direction and also feeding a print medium in a subscan direction crossing the main scan direction, the ink jet printing apparatus comprising:

detection means for detecting a travel range of the print head;

decision means for determining whether or not the detected travel range is a proper travel range;

control means for performing a predetermined control if the decision means decides that the travel range of the print head is not the proper travel range;

an ink tank containing ink to be supplied to the print head and being removably mounted on the print head; and a restricting member for interfering with the ink tank to limit a travel range of the print head to less than a proper travel range only if the ink tank mounted on the print head is not properly mounted on the print head, wherein the print head can removably mount a plurality of kinds of ink tanks and the decision means determines, based on the detected travel range, at least one of the kinds and number of the ink tanks that are not properly mounted on the print head.

2. An ink jet printing apparatus according to claim 1, wherein, when said decision means determines that the travel range of the print head is not the proper travel range, the control means stops a drive means for the print head and at the same time makes an annunciation representing a result of the decision made through a predetermined annunciation means.

3. An ink jet printing apparatus according to claim 2, wherein the annunciation means comprises a display device provided on an ink jet printing apparatus body and the control means causes the display device to display a warning when the decision means determines that the travel range of the print head is not the proper travel range.

4. An ink jet printing apparatus according to claim 2, wherein the annunciation means comprises a display device provided on an external device connected to the ink jet printing apparatus and the control means sends a signal requesting the display device to issue a warning when said decision means determines that the travel range of the print head is not the proper travel range.

5. A method of controlling an ink jet printing apparatus, wherein the ink jet printing apparatus performs printing by moving a print head in a main scan direction and also feeding a print medium in a subscan direction crossing the main scan direction, an ink tank containing ink to be supplied to the print head being removably mounted on the print head, the control method comprising the steps of:

detecting a travel range of the print head;

determining whether or not the travel range is a proper travel range;

performing a predetermined control when it is decided that the travel range of the print head is not the proper travel range; and providing a restricting member to interfere with the ink tank to limit a travel range of the print head to less than a proper travel range only if the ink tank mounted on the print head is not properly mounted on the print head, wherein the print head can removably mount a plurality of kinds of ink tanks and the determining step determines, based on the detected travel range, at least one of the kinds and number of the ink tanks that are not properly mounted on the print head.

* * * * *

UNITED STATES PATENT AND TRADEMARK OFFICE

CERTIFICATE OF CORRECTION

PATENT NO. : 7,104,625 B2
APPLICATION NO. : 10/782786
DATED : September 12, 2006
INVENTOR(S) : Kono et al.

It is certified that error appears in the above-identified patent and that said Letters Patent is hereby corrected as shown below:

COLUMN 1:
Line 56, "apparatus.," should read --apparatus--.
Line 59, should be merged with the prior paragraph.

COLUMN 3:
Line 59, "roller 206" should read --roller--.

COLUMN 5:
Line 55, "lo," should read --10,--.
Line 57, "receive" should read --receiving--.
Line 63, "receive" should read --receiving--.

COLUMN 7:
Line 3, "material 507" should read --material 706--.

COLUMN 8:
Line 42, "a proper" should read --an improper--.
Line 65, "and." should read --and--.

Signed and Sealed this

Tenth Day of June, 2008

JON W. DUDAS
*Director of the United States Patent and Trademark Office*